US005398432A

United States Patent [19]

Vohl

[11] Patent Number: 5,398,432

[45] Date of Patent: Mar. 21, 1995

[54] DYNAMICALLY BALANCED SCREW WITH CONCEALED LOADING WEIGHTS

[75] Inventor: Jean-René Vohl, St-Marc-des-Carrières, Canada

[73] Assignee: Vohl (1992) Inc., St-Marc-des-Carrières, Canada

[21] Appl. No.: 60,964

[22] Filed: May 14, 1993

[51] Int. Cl.[6] ..... E01H 5/09

[52] U.S. Cl. ..... 37/250; 37/249; 37/213; 37/257

[58] Field of Search ..... 37/249, 250, 254, 255, 37/257, 258, 213; 198/676

[56] References Cited

U.S. PATENT DOCUMENTS

| | | | |
|---|---|---|---|
| 158,482 | 1/1875 | Foye | 37/257 X |
| 1,676,823 | 7/1928 | Gault | 37/250 |
| 2,302,127 | 11/1942 | Klauer | 37/255 |
| 2,320,723 | 6/1943 | Gaylord | 37/250 |
| 3,276,571 | 10/1966 | Vohl | 198/676 |
| 3,303,588 | 2/1967 | Krause | 37/250 |
| 3,605,995 | 9/1971 | Maack | 198/676 X |
| 3,812,985 | 5/1974 | Lindeborg et al. | 198/676 X |
| 4,188,738 | 2/1980 | Vohl | 37/257 |

*Primary Examiner*—Dennis L. Taylor

*Assistant Examiner*—Victor Batson

*Attorney, Agent, or Firm*—Pierre Lespérance; Francois Martineau

[57] ABSTRACT

An endless spiralling screw for a snowblower comprising a rotatable elongated shaft, to be power driven; a first, elongated, rigid sheet, integrally mounted to the shaft at a radially inward edge of the sheet and spiralling along the lengthwise axis of the shaft, the main portion of the sheet having a substantially straight section, the external marginal portion of the sheet being folded relative to the main portion thereof, the plane of the main portion being located downstream relative to the direction of rotation of the endless screw; reinforcing struts being anchored to the spiral sheet and having a smaller external diameter than the spiral sheet, and being fixedly connected thereto short of but proximate to the radially outward edge of the spiral sheet and fixedly secured to the shaft at its radially inward edge at an area spaced from the securing area of the radially inward edge of the spiral sheet to the shaft; and counterweights, located inside the hollow of the spiral and integral to a portion of the reinforcing struts, wherein the counterweights are positioned at selected locations whereby dynamic axial balancing of the rotating spiralling screw is achieved.

4 Claims, 3 Drawing Sheets

DYNAMICALLY BALANCED SCREW WITH CONCEALED LOADING WEIGHTS

FIELD OF THE INVENTION

This invention relates to the snow removal equipment used by municipalities, and particularly to the auger screws of snowblowers.

CROSS-REFERENCE DATA

The subject matter of Canadian patent No 704,837 issued Mar. 2, 1965 in the name of the present assignee, is hereby incorporated by way of reference to the present patent application.

BACKGROUND OF THE INVENTION

Canadian patent No 704,837 issued in 1965 to the present assignee, discloses an automotive snow blower truck, provided with a front collector frame unit, defining a front mouth. When the truck moves forward, incoming ground-standing snow enters into the collector unit through the front mouth thereof. Two horizontal endless screws, superimposed over one another, are carried inside the collector unit for capturing and crushing incoming snow and ice, and for conveying the crushed snow and ice toward a snow-ejecting fan outlet made intermediately of the back wall of the collector unit. Each endless screw includes a power-driven shaft and two elongated sheet members, integrally mounted to the shaft and spiralling therealong. Additional spiralling sheet members are provided to reinforce the first sheet members. The claimed purpose of the reinforcing sheet members is to positively prevent structural deformation of the spiralling sheet members, when the rotating sheet members are operatively crushing the incoming snow and ice.

It is natural for (unloaded) one-entry endless spiralling screws of snow blower trucks not to be balanced, which means that these screws will vibrate and jump upon rotation thereof. To alleviate this problem, weight members are conventionally added to the exterior face of the spiralling screw, at selected locations, in order to compensate for the imbalance. However, such weight members, because they project exteriorly of the outer surface of the spiralling screw, do form physical obstructions to the free movement of the ice and snow conveyed by the spiralling screw. Such obstructions decrease the efficiency and durability of the spiralling screw.

OBJECTS OF THE INVENTION

The gist of the invention is therefore to provide axial balancing means for the spiralling auger screws of snow blower trucks, of a type which will not decrease the efficiency and durability of the spiralling screw.

A corollary object of the invention is to improve upon the spiral screw disclosed in Canadian patent No 704,837.

SUMMARY OF THE INVENTION

Accordingly with the objects of the invention, there is disclosed an endless spiral screw for a snowblower collector, comprising: a rotatable elongated shaft, to be power driven; an elongated, rigid sheet member, integrally mounted to said shaft at a radially inward edge thereof and spiralling lengthwisely of said shaft, the main portion of said sheet member having a substantially straight section, the radially outward marginal portion of said sheet member being folded relative to said main portion thereof; at least a few rigid, reinforcing, strut members, extending transversely of corresponding sections of said shaft and of said sheet member, said strut members being provided for preventing deformation of said sheet member under high load strains; each said strut member having a radial length smaller than that of said spiral sheet member, and being fixedly connected to the latter short of the radially outward edge of said sheet member at its radially outward marginal portion and being fixedly secured to said shaft at its radially inward edge at an area spaced from the securing area of the radially inward edge of said sheet member to said shaft; and counterweight means, located inside and completely concealed within at least selected ones of said at least a few rigid strut members, whereby dynamic axial balancing of the spiralling screw is achieved once the screw is submitted to a rotating bias.

Preferably, each said strut member radially inward edge is spaced upstream from the corresponding shaft securing area of said strut member radially inward edge, relative to the spiralling direction defined by said spiral sheet member.

Preferably, each said reinforcing member defines a flat, spiralwisely-tilted surface.

Preferably, each said reinforcing strut member defines a generally triangular shape in plan view.

DETAILED DESCRIPTION OF THE INVENTION

Figure 1:
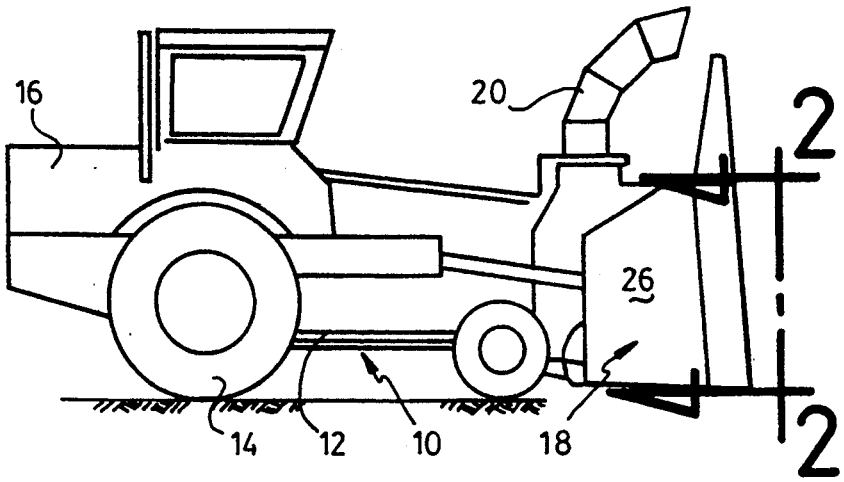
FIG. 1 is a side elevation of a snow blower truck according to the invention.
Figure 2:
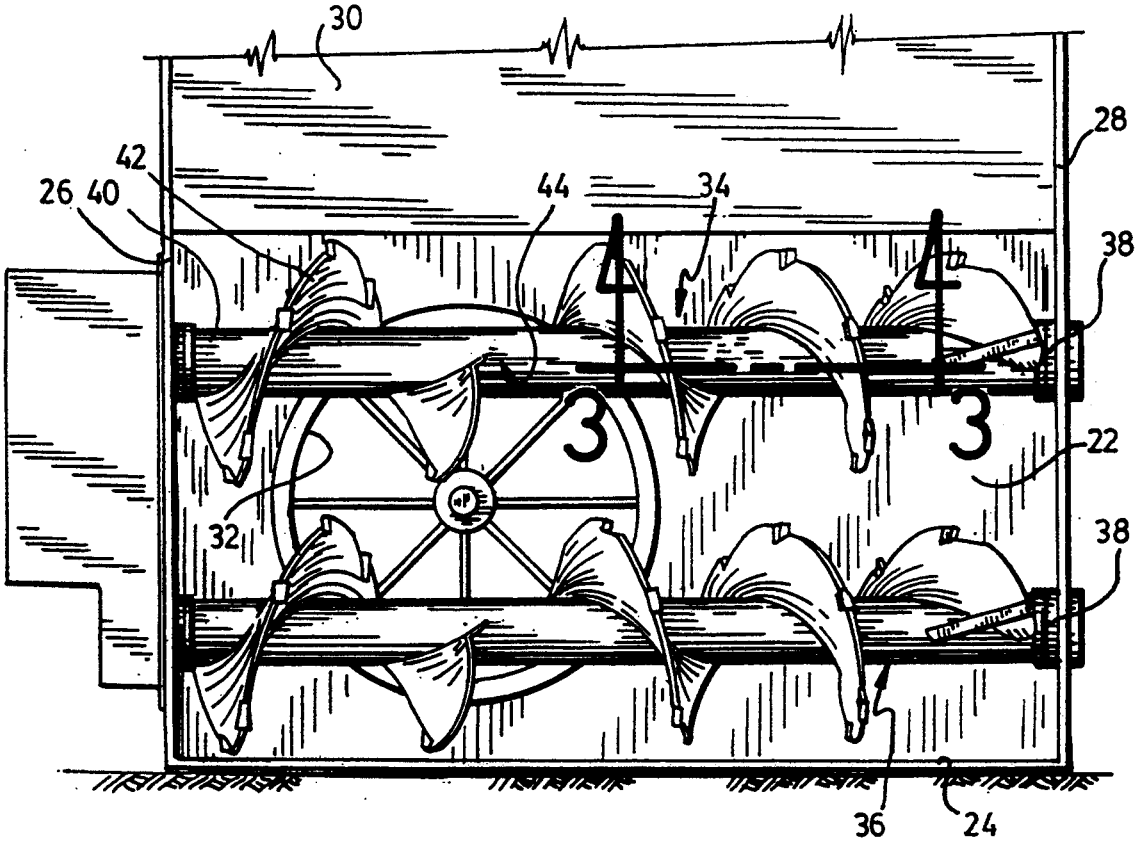
FIG. 2 is an enlarged front elevation of the snow blower truck, taken from perspective 2—2 of FIG. 1.
Figure 3:
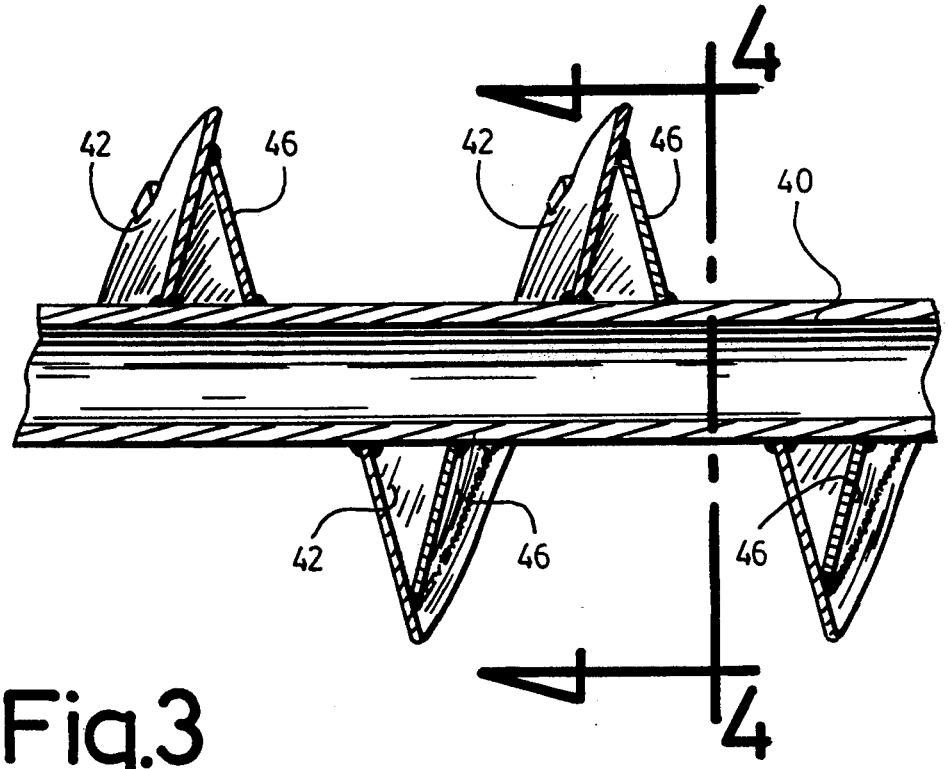
FIG. 3 is an enlarged sectional view of the collector screw of the snow blower of FIG. 1, taken along line 3—3 of FIG. 2.
Figure 4:
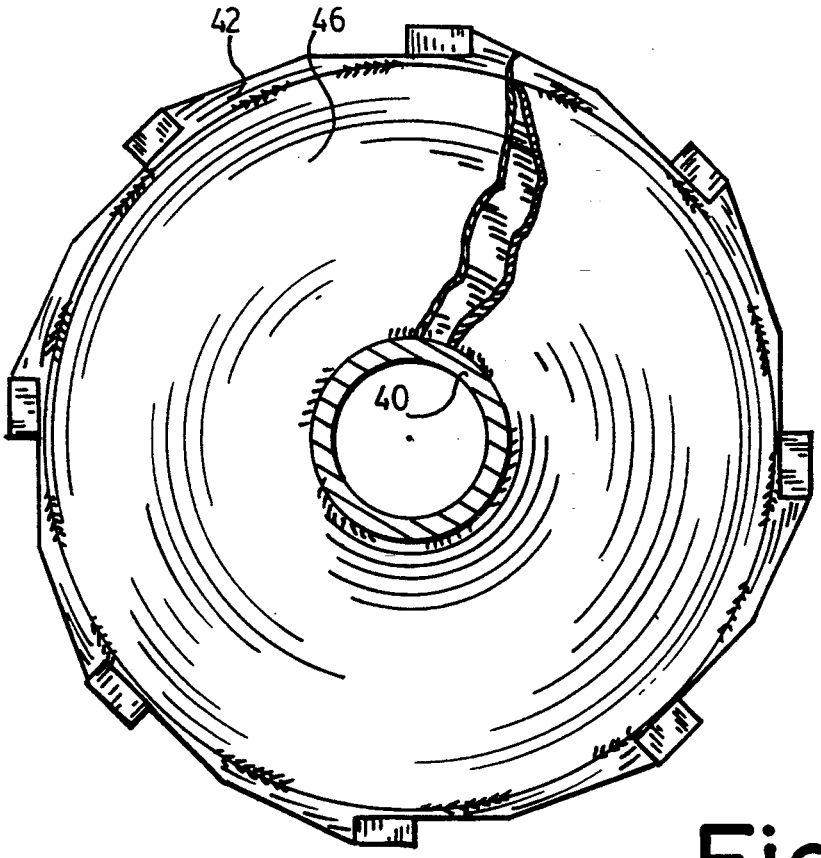
FIG. 4 is an enlarged cross-section of the spiral screw, taken about line 4—4 of FIG. 3.

The snow blower truck 10, illustrated in FIG. 1, is of generally conventional construction. Truck 10 includes a chassis 12, carried over ground by wheels 14, a power train 16, a front loaded snow collector 18, and a snow chute 20 for ejecting the snow having engaged the snow collector 18. The snow collector 18 defines a back wall 22, a leading edge bottom wall 24, two opposite lateral (vertical) side walls 26, 28, and an (inclined) top wall 30. A snow outlet 32 is defined at an intermediate section of the back wall 22. Two horizontally-extending, superimposed, endless screw members 34, 36, are rotatably mounted to the collector unit side walls 26, 28, by known mounting means, 38. Each screw member 34, 36, defines a power driven shaft, 40, and an elongated, spiralling sheet member 42 of constant pitch throughout the length of the spiral screw 34 or 36.

According to the invention, each sheet member 42 includes an intermediate discontinuity, or gap, 44, in facing register with the snow-ejecting fan outlet 32 of the back wall 22, whereby each spiral 42 is divided in two laterally spaced half-sections. The two spiral screw half-sections are not of equal lengths. To each half section of spiral 42 is fixedly anchored at least a few transversely extending, lengthwisely spaced, reinforcing strut members 46. Each transverse strut member 46 is anchored to the leading face of the spiral sheet 42, i.e. on the leading side of the spiral hollow relative to the spiralling direction of the spiral screw. Moreover, each strut member 46 is radially shorter in length than the spiral sheet 42, so that the radially outward edge 46*a* of the strut member 46 is anchored to a (leading face) section of the spiral sheet 42 which is short of the radially outward edge 42*a* of the spiral sheet 42.

Figure 5:
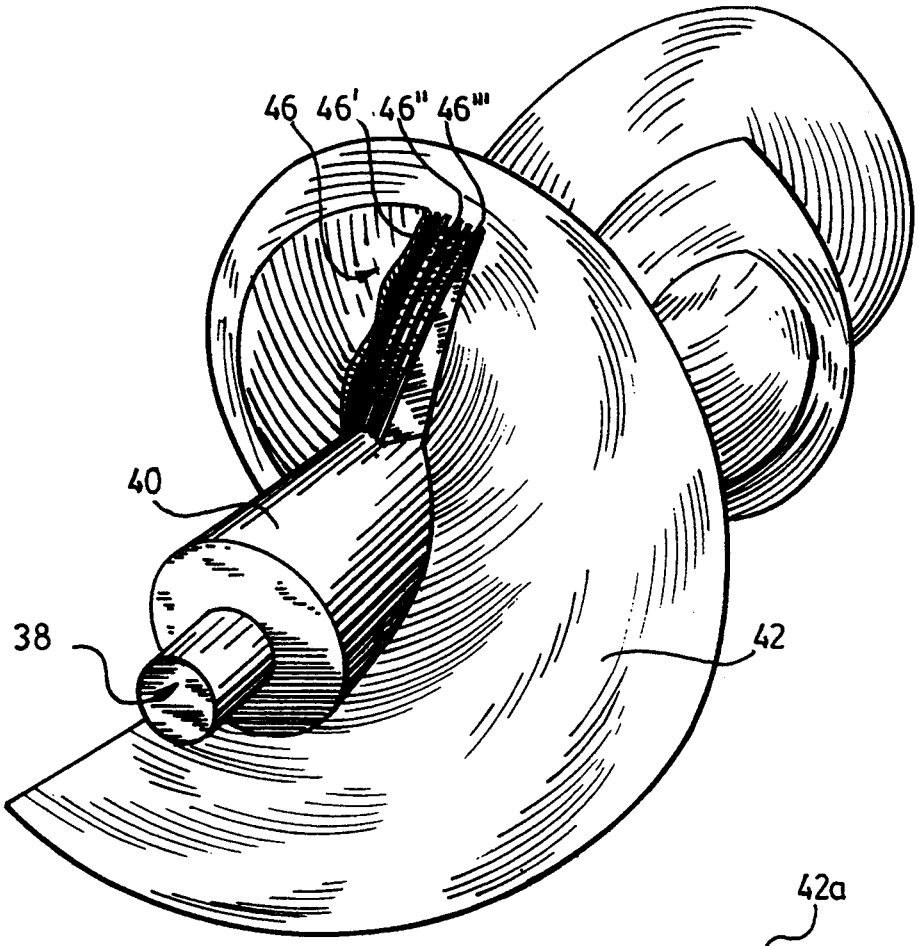
FIG. 5 is a perspective view of the collector screw, clearly showing the integral weight loading mass forming the balancing means according to the teachings of the invention.
Figure 6:
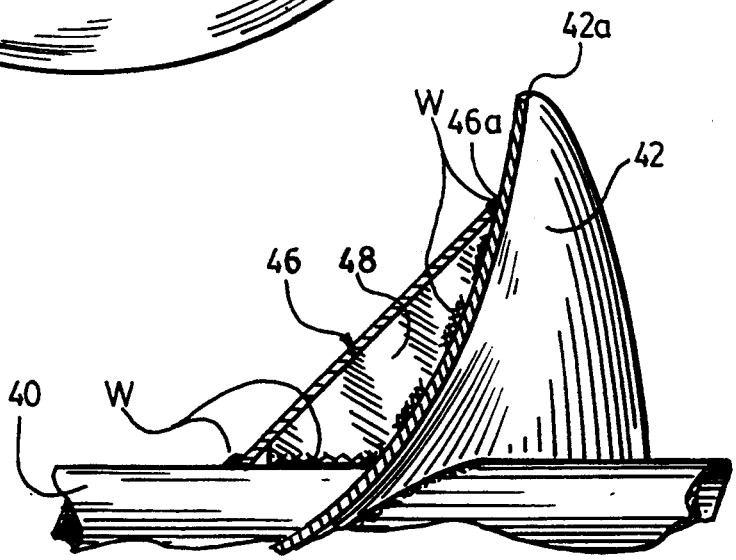
FIG. 6 is a cut-away cross-sectional view of the portion of collector screw bearing the balancing means collector screw.

As illustrated in FIG. 5, each strut member 46 may consist of a number of generally triangular plates 46', 46'', 46''', . . . , spacedly interconnected to one another and to the shaft 40 and spiral sheet 42 e.g. by welding W.

According to the heart of the invention, each core body of the interconnected strut plates 46', 46'', . . . of selected ones of said strut members 46, is integrally formed with a weight loading mass, 48. The loading mass is concealed within the body of the strut member 46, and does not project outwardly therefrom in any way, e.g. the loading mass 48 does not project radially outwardly of the radially outward edge 42*a* of the spiral 42, nor axially of the reinforcing strut members 46. Therefore, the loading mass 48 does not hamper nor obstruct in any way the free circulation of snow or ice packs conveyed by the rotating screw 42 toward the snow-ejection fan outlet 32.

The loading mass 48, e.g. a high-density material embedded into the core of the strut plates, may be for example lead, or the like, material, provided they are rustproof-treated. Loading masses 48 are therefore integrally made part of at least some selected strut members 46. The strut members 46 so selected are chosen as a matter of balancing the rotating screw, i.e. to prevent the single-entry screw from vibrating or worse jumping as the one-entry screw builds up rotating speed. As already explained hereinabove, such vibrations are the normal outcome of an unloaded (unbalanced) one-entry rotating spiral screw, which is why weight loading masses anchored at selected portions of the spiral screw are essential in view of providing a high performance, substantially vibration-free spiral screw. It is not required that each and every strut member 46 include an embedded weight loading mass, but at least some of the strut members 46 should be loaded in this way, so as to achieve the axial balancing of the spiral screw. The strut members to be loaded are selected by any acceptable way, for example empirically, i.e. manually, via the trial and error technique.

I claim:

1. An endless spiralling screw for a snowblower collector, comprising:

(a) a rotatable elongated shaft, to be power driven;

(b) an elongated, rigid sheet member, integrally mounted to said shaft at a radially inward edge thereof and spiralling along the lengthwise axis of said shaft, the main portion of said sheet member having a substantially straight section, the radially outward marginal portion of said sheet member being folded relative to said main portion thereof;

(c) rigid, reinforcing, strut members, extending transversely of said shaft and of said sheet member, said strut members being provided for preventing deformation of said sheet member under high load strains; each said strut member having a radial length smaller than that of said spiral sheet member, and being fixedly connected to the latter short of but proximate to the radially outward edge of said sheet member and being fixedly secured to said shaft at its radially inward edge at an area spaced from the securing area of the radially inward edge of said sheet member to said shaft; and (d) counterweight means, located inside and completely concealed within at least some of said strut members, whereby dynamic axial balancing of the spiralling screw is achieved once the screw is submitted to a rotating bias.

2. An endless spiralling screw as defined in claim 1, wherein each said strut member is anchored to the leading face of the spiral sheet.

3. An endless spiralling screw as defined in claim 1, wherein each said reinforcing member defines a flat, helical surface.

4. An endless spiralling screw as defined in claim 1, wherein each said reinforcing strut member defines a generally triangular shape in plan view.

* * * * *